United States Patent [19]

Couturier

[11] Patent Number: 4,770,402

[45] Date of Patent: Sep. 13, 1988

[54] CLIP SEPARATOR FOR INTERFOLDED SHEETS

[75] Inventor: Dennis Couturier, Washburn, Wis.

[73] Assignee: C. G. Bretting Manufacturing Company, Ashland, Wis.

[21] Appl. No.: 40,546

[22] Filed: Apr. 17, 1987

[51] Int. Cl.[4] ..... B41L 1/32

[52] U.S. Cl. ..... 270/39; 493/357; 493/410

[58] Field of Search ..... 270/32, 39–42, 270/55, 57, 58, 95, 21.1, 52.5; 493/357, 345–346, 372, 400, 405, 406, 409–412, 416–417, 429–430

[56] References Cited

U.S. PATENT DOCUMENTS

| | | | |
|---|---|---|---|
| 2,929,624 | 3/1960 | Brooker | 270/39 |
| 3,163,413 | 12/1964 | Franke et al. | 270/39 |
| 3,784,188 | 1/1974 | De Ligt | 493/358 |
| 4,070,014 | 1/1978 | Takahashi | 270/39 |
| 4,396,336 | 8/1983 | Malamood | 270/95 |
| 4,406,650 | 9/1983 | Felix | 493/410 |
| 4,475,730 | 10/1984 | Trogan | 270/41 |
| 4,494,741 | 1/1985 | Fischer et al. | 270/39 |
| 4,508,527 | 4/1985 | Uno | 493/357 |
| 4,650,447 | 3/1987 | Meschi | 493/357 |
| 4,673,382 | 6/1987 | Buck et al. | 270/39 |

FOREIGN PATENT DOCUMENTS

| | | | |
|---|---|---|---|
| 372031 | 3/1923 | Fed. Rep. of Germany | 270/39 |

OTHER PUBLICATIONS

"Terminology as Applied to Breiting Chain Separator Transfer-T/LT", 3/5/8. Ser. No. 3650-86 JG4, (13 page brochure).

*Primary Examiner*—Eugene H. Eickolt
*Attorney, Agent, or Firm*—Faegre & Benson

[57] ABSTRACT

An automatic separator for separating predetermined quantities of items such as paper napkins, includes an interfolding table at a package building station to form an interfolding process stack, an actuatable platform count finger positionable above the interfolding table to provide a platform for continuing the interfolding process, a carriage to move the clip on the interfolding table to a separator outlet station, a package build finger positionable relatively closely below the platform count finger to orient the depending loose end sheet to be the bottommost layer when the interfolding process stack is again supported by the interfolding table, and an initial count finger actuatable to a position above the interfolding table after a predetermined number of sheets have been interfolded into a clip such that the initial count finger rests on the clip.

19 Claims, 9 Drawing Sheets

CLIP SEPARATOR FOR INTERFOLDED SHEETS

FIELD OF THE INVENTION

This invention relates to an automatic separator for separating predetermined quantities of items such as paper napkins, towels, or similar items.

DETAILED DESCRIPTION

Figure 1:
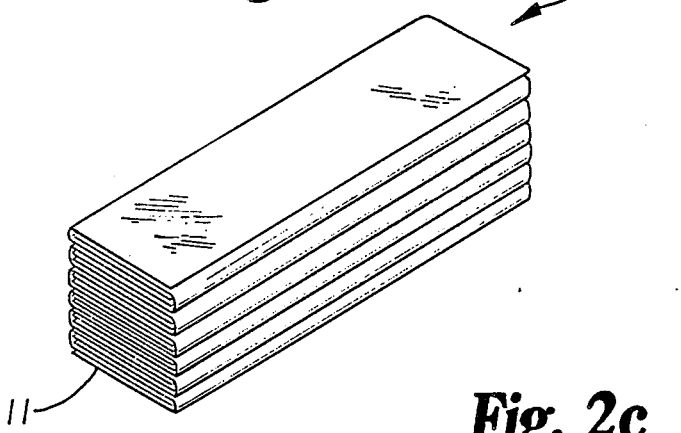
FIG. 1 is a pictorial drawing of a clip of folded, interlayered facial tissues.

FIG. 1 shows a clip 10 formed from a stack of interfolded laminar products or items 11 such as paper napkins, towels, or facial tissues.

Figure 1A:
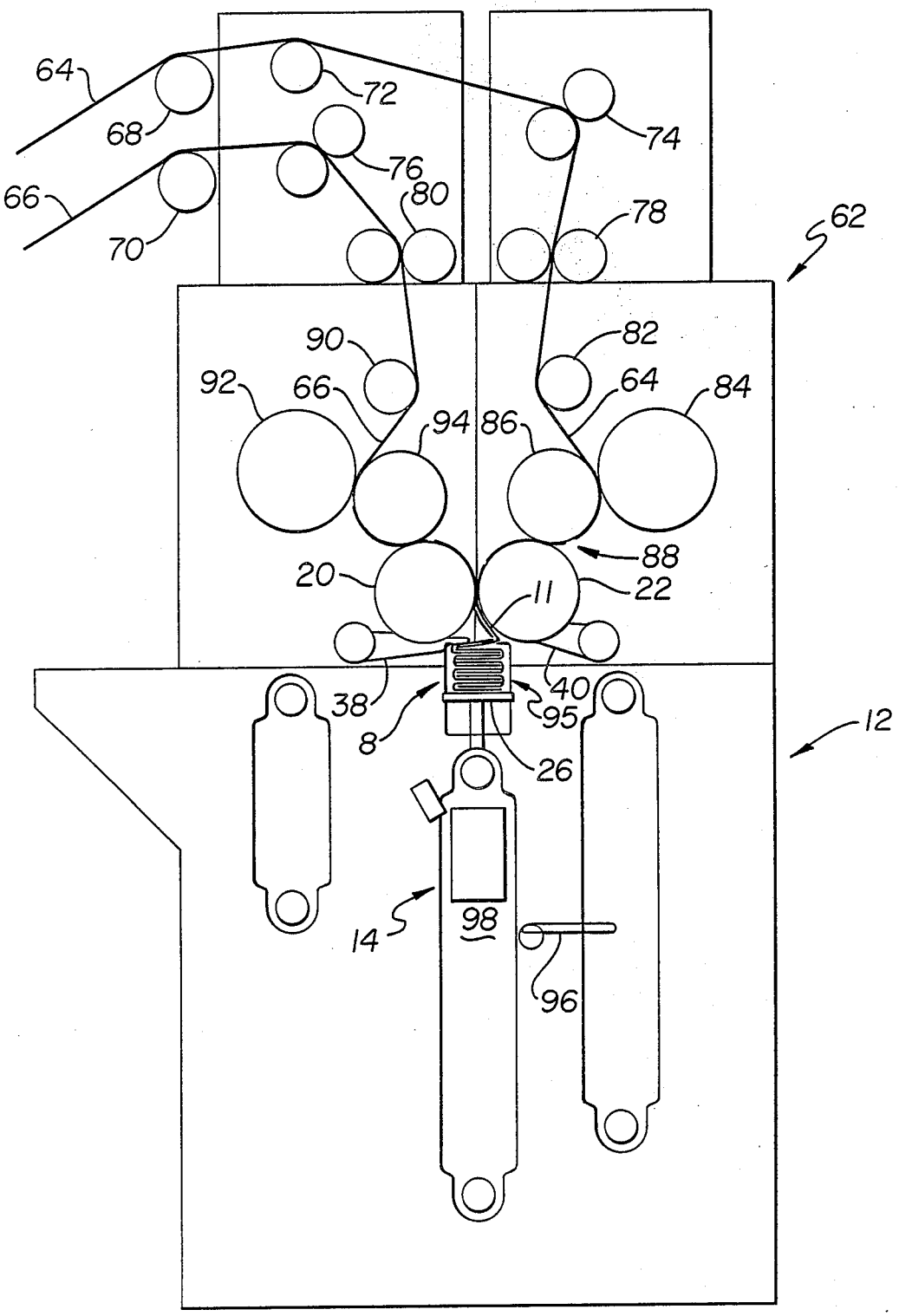
FIG. 1*a* is a simplified right side elevation view of a web cutting and folding and clip separating machine.

FIG. 1*a* shows a simplified view of the machine environment of this automatic separator invention. Machine 62 receives two continuous webs or sheets 64, 66 and processes them by slitting longitudinally, cutting transversely, interfolding the cut-web sheets and stacking them in a continuous fashion.

Webs 64, 66 pass over spreader rolls 68, 70 which may be conventional Mount Hope-type rolls. Web 64 then passes over idler roll 72. Webs 64, 66 then pass through slitter roll pairs 74, 76 and folder feed roll pairs 78, 80. After passing over idler roll 82, web 64, passes between cutoff roll 84 and cutoff bedroll 86 where it is severed transversely (indicated by gaps 88 in web 64). Similarly web 66 passes over rolls 90–94. Webs 64, 66 are then transferred respectively to folding rolls 22, 20.

Folding rolls 22, 20 interfold severed webs 64, 66 and release the interfolded severed webs or cut sheets 11 to be built into a stack 8 on a table 26 by a pair of packer fingers 40, 38.

An automatic separator 12 is located in the lower portion of machine 62 and periodically separates a clip 10 of a predetermined number of sheets 11 from the continuously building stack 8 on an interfolding table 26 carrying clip 10 to a separator outlet position 98 adjacent a reject gate 96.

Figure 2:
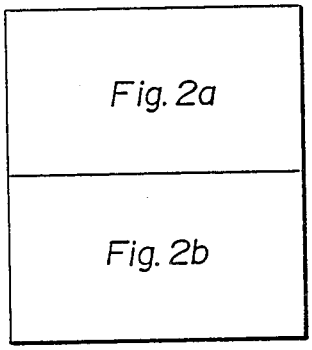
FIG. 2 is a multiple sheet organization diagram on the orientation of FIGS. 2*a* and 2*b*.
Figure 2C:
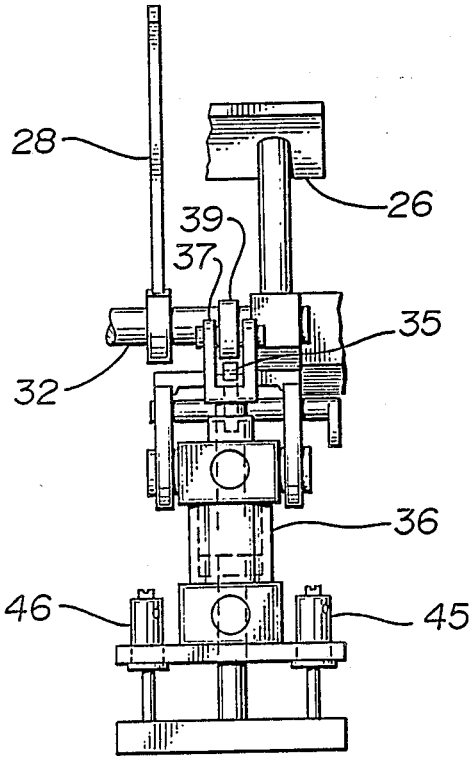
FIG. 2*c* is a rear elevation view taken along line 2*c*—2*c* of FIG. 5.
Figure 2A:
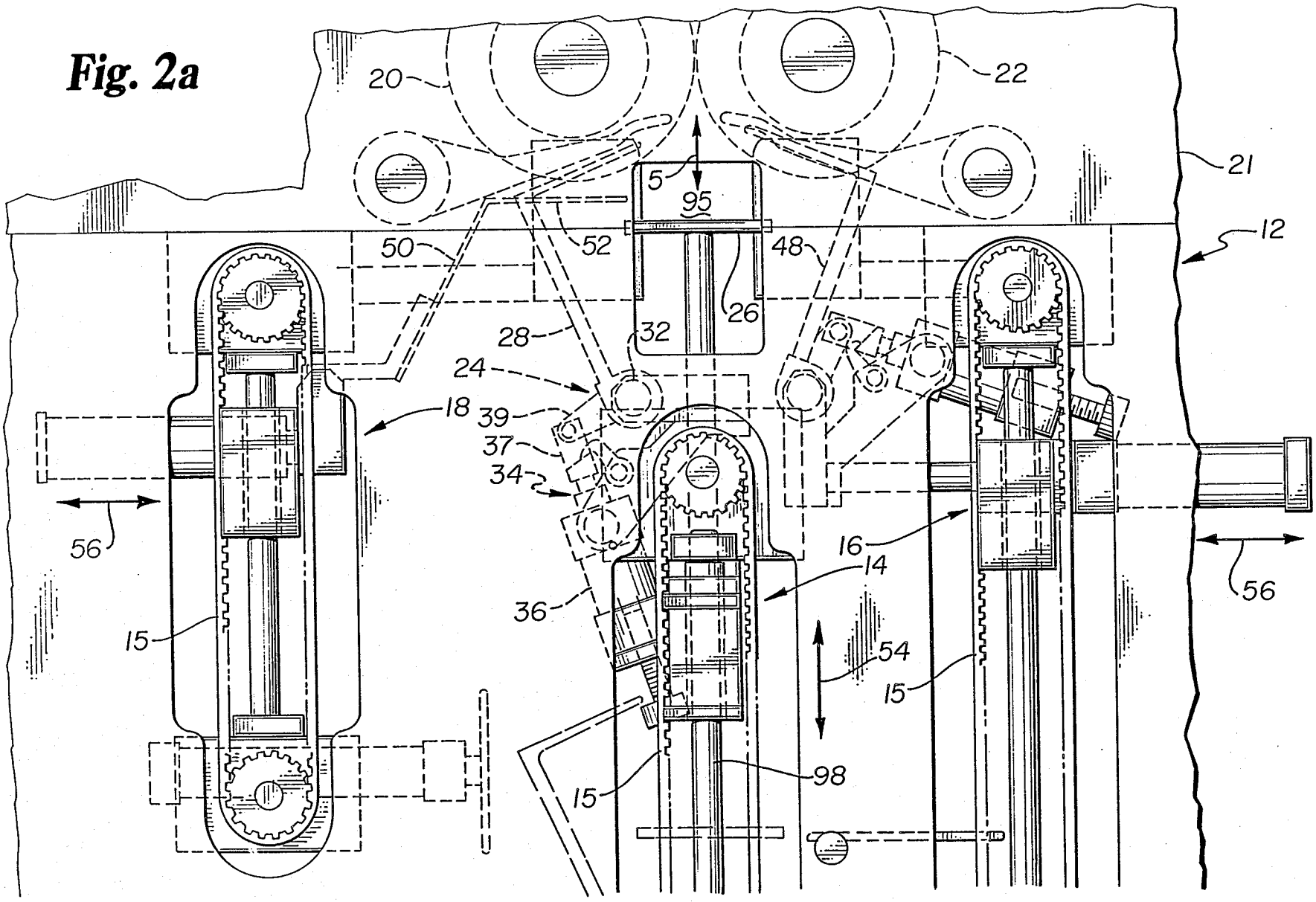
FIG. 2*a* is a fragmentary right side elevation view of the clip separator portion of the machine of FIG. 1*a*.
Figure 2B:
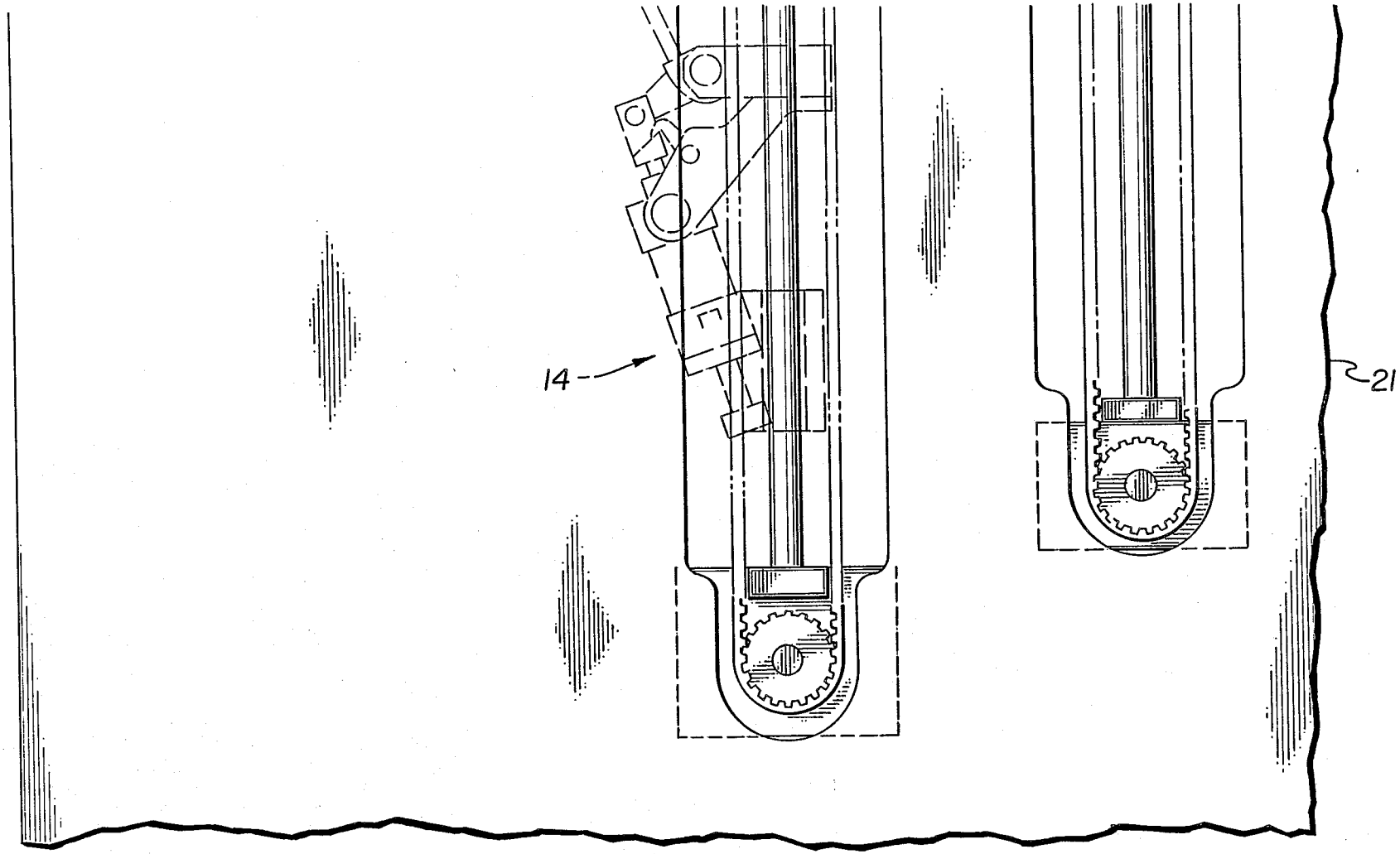
FIG. 2*b* is a fragmentary right side elevation view of a portion of the machine adjoining FIG. 2*a*.

Automatic separator 12 is shown in more detail in FIGS. 2*a*–2*b* and in various positions during a clip separation cycle in FIGS. 5–11. A stack principal axis 5 represents the direction along which stack 8 is built. Separator 12 has three moveable carriages 14, 16, 18. The center carriage is the first count finger/interfolding table carriage 14 and is located directly below the folding rolls 20, 22 at a package building station 95 and is movable along the stack principal axis 5. As will be later described in greater detail, carriages 14–18 operate to separate interfolded sheets 11 into a succession of clips 10 each having a predetermined number of sheets 11. As a part of this process, carriage 14 moves the separated clip 10 from the folding rolls 20, 22 to the separator outlet position 98 for further processing. Such further processing may include orienting and shaping clip 10 prior to inserting clip 10 into a box or other package. A first count finger assembly or retention means 24 and interfolding or elevator table 26 are mounted on carriage 14. Carriages 14, 16 and 18 are movable by positive drive belts 15 and motors (not shown) or other drive means which allow controlled positioning.

Figure 3:
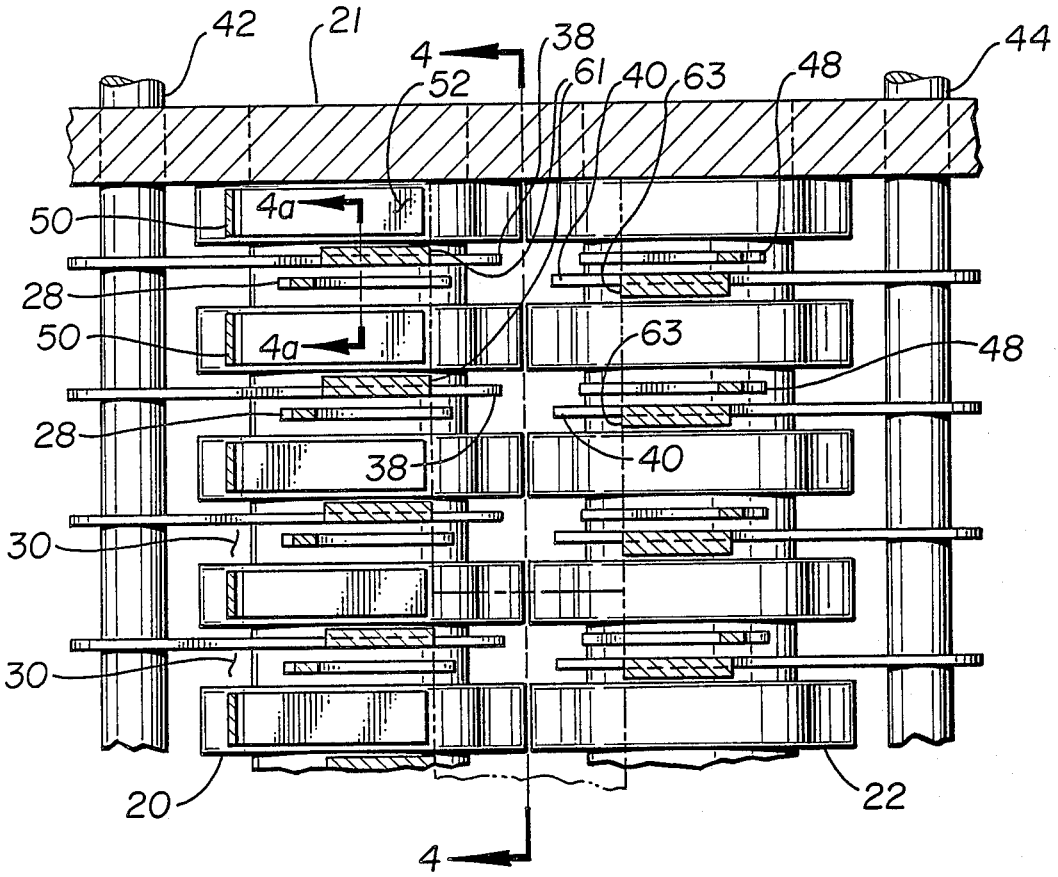
FIG. 3 is a bottom plan view of a portion of the machine shown in FIG. 2*a*.
Figure 4:
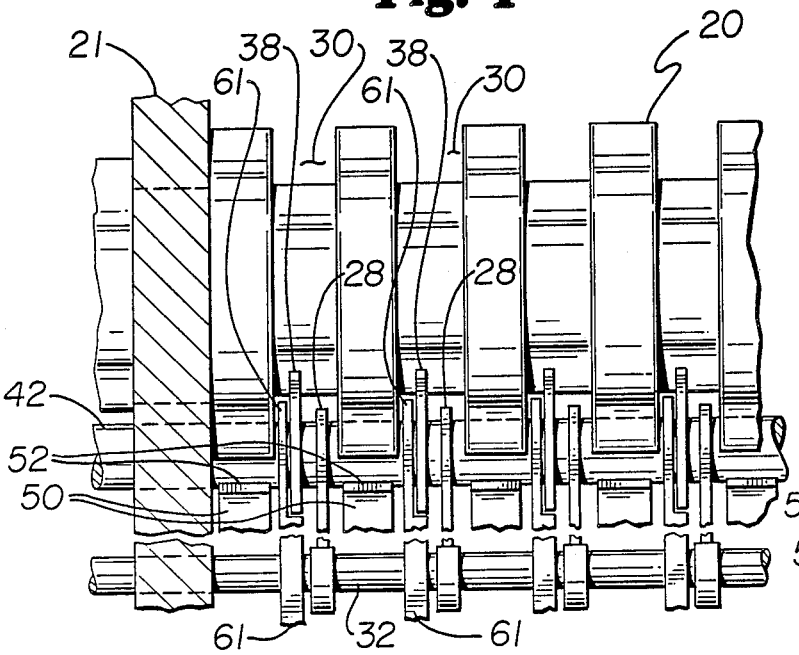
FIG. 4 is a front elevation section view taken along line 4—4 of FIG. 3.
Figure 4A:
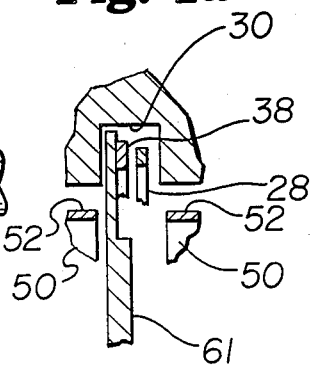
FIG. 4*a* is a fragmentary elevation section view taken along line 4*a*—4*a* of FIG. 4.
Figure 5:
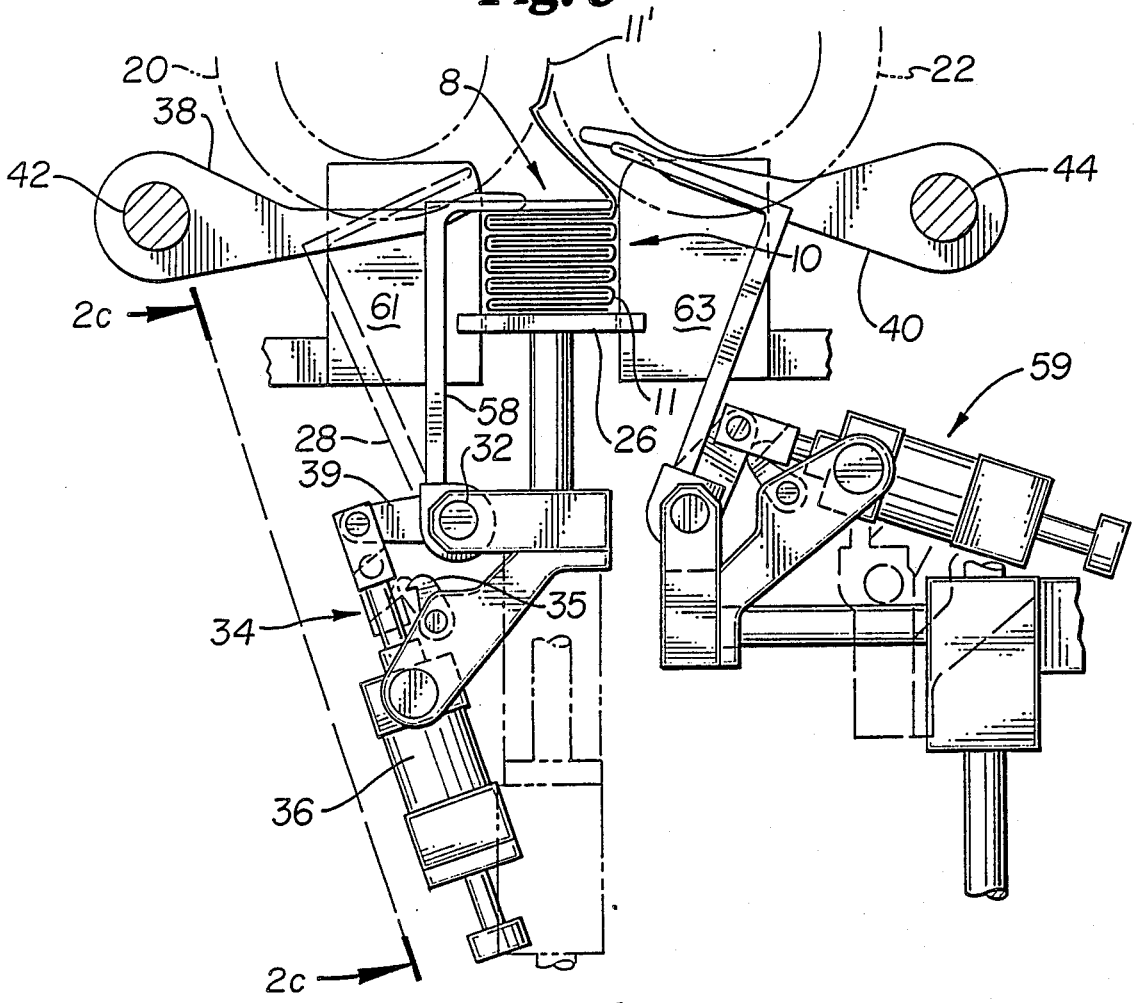
FIG. 5 is a simplified right side elevation view of elements of the machine of FIG. 1*a* and 2*a* at the beginning of a clip separation cycle where the first count fingers are actuated.

As may be seen in FIGS. 3, 4 and 5, a plurality of first or initial count fingers 28 are transversely aligned with radial grooves 30 in folding roll 20 which itself is mounted for rotation in machine frame 21. First count fingers 28 are mounted to a pivoting shaft 32 to which a torque is applied by an actuator 36 which may be a mechanical spring or pre-loaded air cylinder. Shaft 32 is prevented from moving in response to the applied torque by mechanical latch 34.

A plurality of first and second packer fingers 38, 40 are mounted on first and second packer finger shafts 42, 44 respectively and operate in a conventional manner to build stack 8 as may be seen in FIGS. 3–7. A plurality of stationary guides 61, 63 serve to align successive layers 11 as they are built into stack 8 along stack principal axis 5.

Referring now also to FIG. 2*c*, at a desired time (after a predetermined number of sheets 11 have been interfolded into stack 8 and between folds when first packer fingers 38 are actuated as in FIG. 5) hook 35 of latch 34 is released and the actuator 3 operates through clevis 37 and link 39 to move count fingers 28 toward table 26 in a pivoting motion which ends in a controlled deceleration to avoid shock or impact loading of fingers 28. The controlled deceleration is accomplished by hydraulic shock absorbers 45, 46 operating mechanically in parallel with actuator 36 at the end of pivoting motion of fingers 28 as they come to rest in an actuated position 58 so as to retain clip 10 (as shown in FIG. 5).

Carriage 16 includes a plurality of pivoting second or platform count fingers 48 controlled by a latch and actuator mechanism 59 similar to that which operates first count fingers 28.

Carriage 18 carries a plurality of package build fingers 50, each of which has a relatively flat end portion 52.

Each of carriages 14, 16, 18 is capable of controlled movement in the "Y" or package build direction 54. Direction 54 is parallel to the stack principal axis 5. In addition, carriages 16 and 18 are also capable of controlled movement in the "X" direction 56 for clearance purposes as will be described in more detail. Although direction 54 is shown to be vertical and direction 56 is shown to be horizontal, it is to be considered within the scope of this invention that these directions are not limited to vertical and horizontal, respectively, and are utilized merely to aid in understanding the operation of this invention. As a further aid in describing this invention, upward movement along direction 54 and rightward movement along direction 56 will be considered positive, while downward and leftward movement will be considered negative.

The operation of separator 12 is as follows. Cut web interfolding is performed continuously by folding rolls 20, 22 cooperating with first and second packer fingers 38, 40 forming or building stack 8 on table 26. In FIG. 5, stack 8 which will become separated as clip 10 is shown at the beginning of a separation cycle. Once a predetermined number of sheets 11 have been built into stack 8 by folding rolls 20, 22 and packer fingers 38, 40 between guides 61, 63 on table 26, latch 34 releases first count fingers 28. First count fingers 28 then come to rest in an actuated position 58. Clip 10 is now held between count fingers 28 in position 58 and table 26. It is to be understood that folding rolls 20, 22 and packer fingers 38, 40 continue uninterrupted operation throughout the clip separation cycle.

Figure 6:
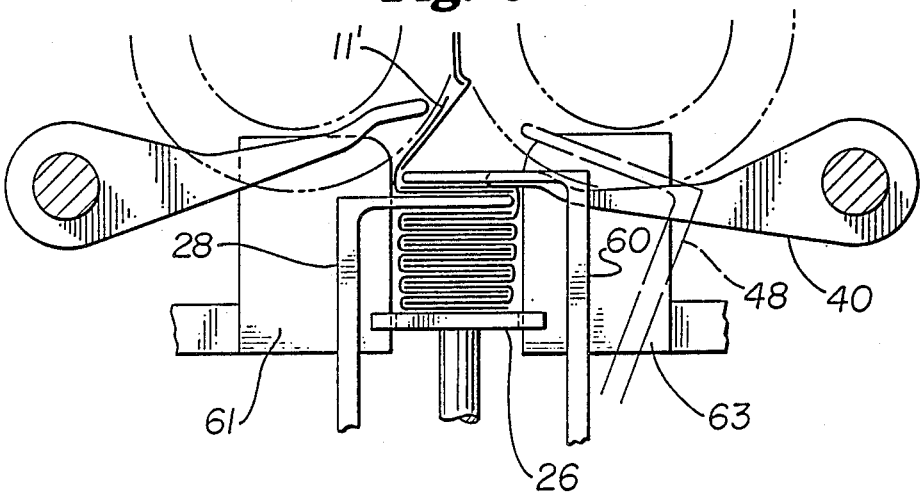
FIG. 6 illustrates elements of the machine just past the beginning of the clip separation cycle where the second count fingers are actuated.

Referring now to FIG. 6, second or platform count fingers 48 are actuated from a ready position away from the stack principal axis one fold after actuation of the first count fingers, when second packer fingers are actuated. Second count fingers move transversely (in an arc) toward the stack principal axis 5 and come to rest in an actuated position 60.

As may be seen most clearly in FIG. 7–10, second count fingers 48 in actuated position 60 provide a platform to support continued building of succeeding sheets or laminar products 11' into stack 8.

As successive sheets 11' are building, separated clip 10 is rapidly moved away from the folding rolls 20, 22 by carriage 14 moving in the −Y direction. It is to be understood that the rate of this motion is preferably substantially greater than the stack build rate motion. At this time, second count finger carriage 16 is gradually continuously moved downward at a rate corresponding to the build rate of successive clip 10' such that each successive new top sheet 11' of stack 8 is properly positioned by packer fingers 38, 40. Carriage 14 moves clip 10 from the package build station or position 95 to the separator outlet station or position 98. Carriage 14 is shown at station 95 in FIG. 2*a* and at station 98 in FIG. 2*b*. Retention fingers 28 hold clip 10 to table 26 as carriage 14 moves from position 95 (shown in FIG. 7) to position 98 (shown in FIG. 8).

Figure 8:
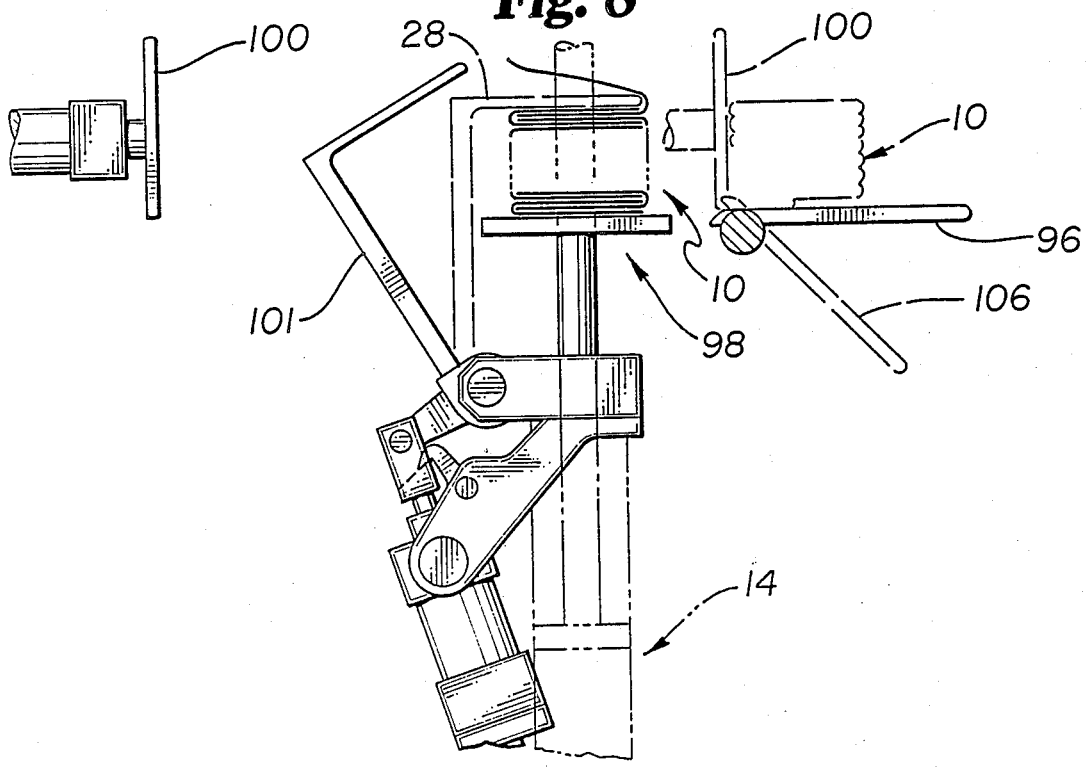
FIG. 8 illustrates elements of the machine still further in the cycle where the separated clip is transferred out of the separator.

As may be seen in FIG. 8, while carriage 14 holds clip 10 in position 98, ejector 100 moves clip 10 to reject gate 96. Normally gate 96 remains stationary. In the event a defective clip is formed, it may be rejected immediately after separation from the package building stack by pivoting gate 96 to position 106. By locating reject gate at the separator outlet station 98, further processing of defective clips is eliminated, thus improving machine efficiency. Actuator 100 may be a bi-directional air cylinder or other conventional actuator. Retention or initial count fingers 28 are then retracted to a deactuated position 101 (as shown in FIG. 8).

Figure 7:
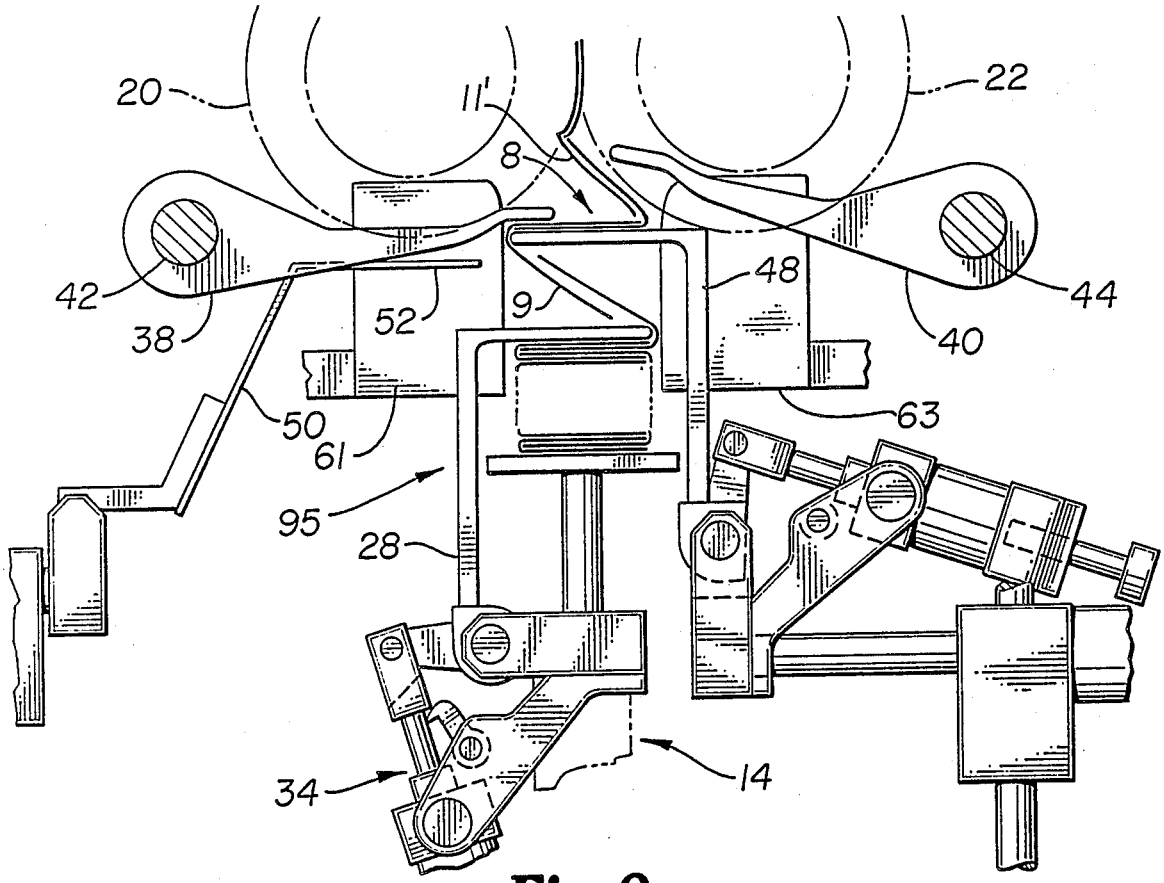
FIG. 7 illustrates elements of the machine at a position later in the cycle where a completed clip is separated from the continuously building stack.
Figure 9:
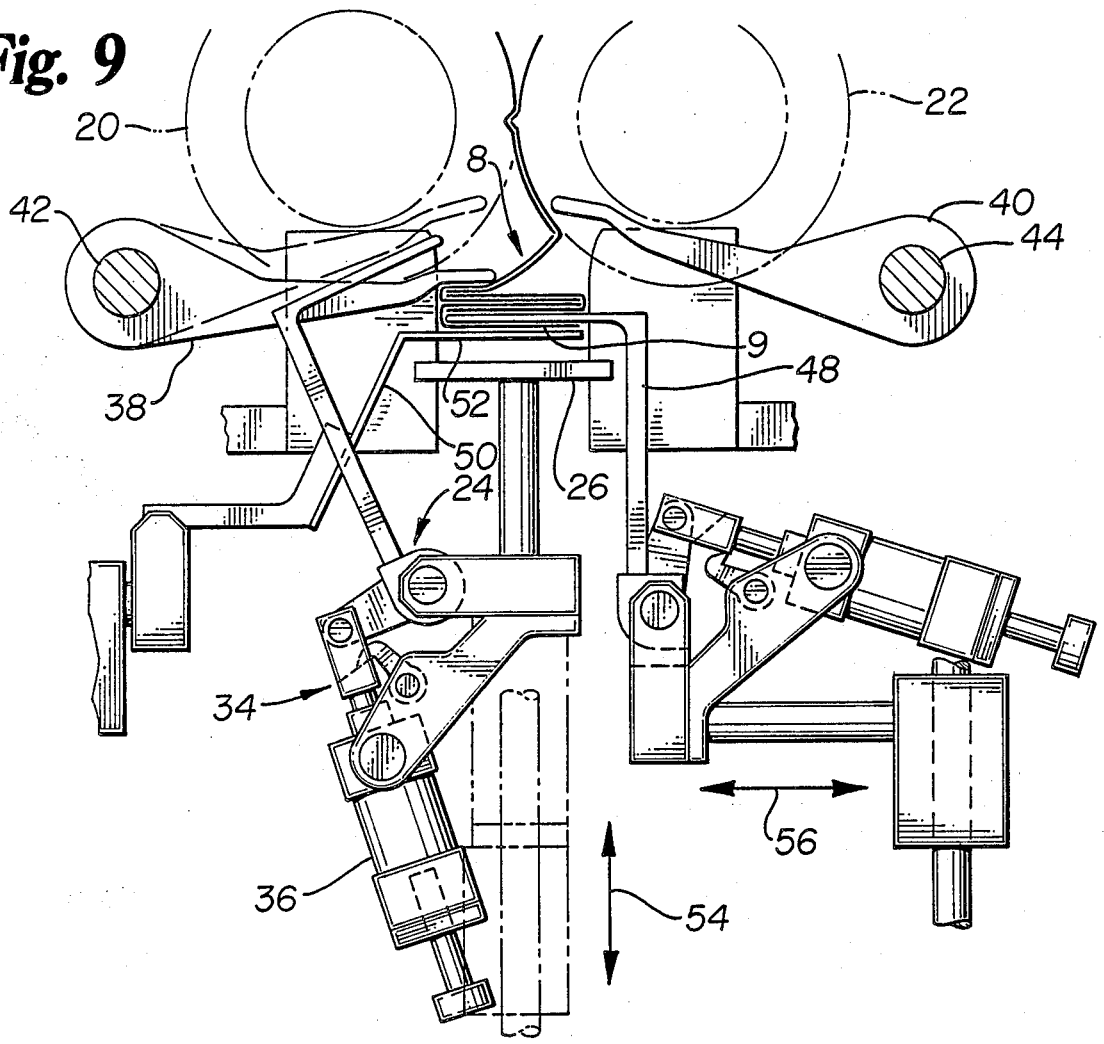
FIG. 9 illustrates the elements of the machine still further in the cycle where the package build fingers become operative.

Referring now to FIGS. 7 and 9, a plurality of package build fingers 50 having relatively flat end portions 52 (as may be observed in FIGS. 3 and 4) are now translated laterally relatively closely below the second count fingers 48 tucking a loose end sheet portion 9 under stack 8 such that portion 9 will form the bottommost layer for new clip 10' to be separated from stack 8.

Figure 10:
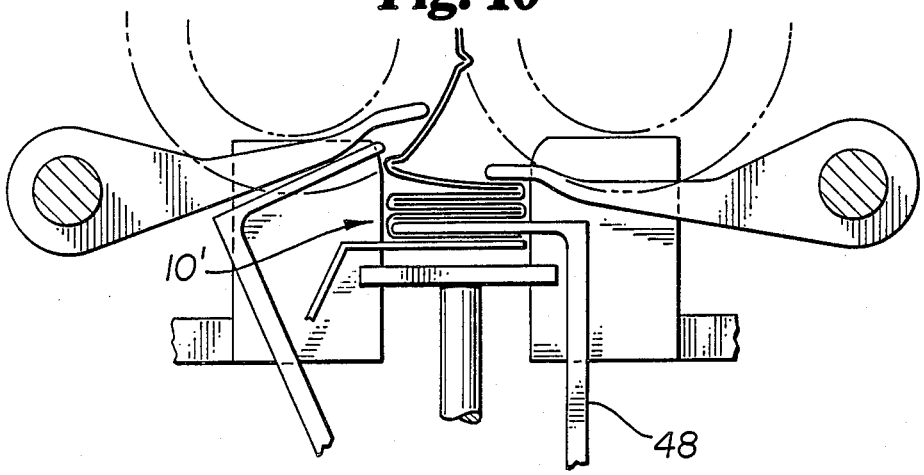
FIG. 10 illustrates elements of the machine still further in the cycle where stack building continues on the second count fingers.

Referring now to FIG. 10, the stack 8 continues to build from folding rolls 20, 22 and packer fingers 38, 40. As stack or package building continues, second count fingers 48 continue to move relatively slowly downward in the −Y direction such that the topmost layer of stack 10' is properly positioned with respect to packer fingers 38, 40. During this process, carriages 16 and 18 move together. Carriage 14 carrying table 26 may be stationary or may be adjusted to be positioned to the package building station 95.

Figure 11:
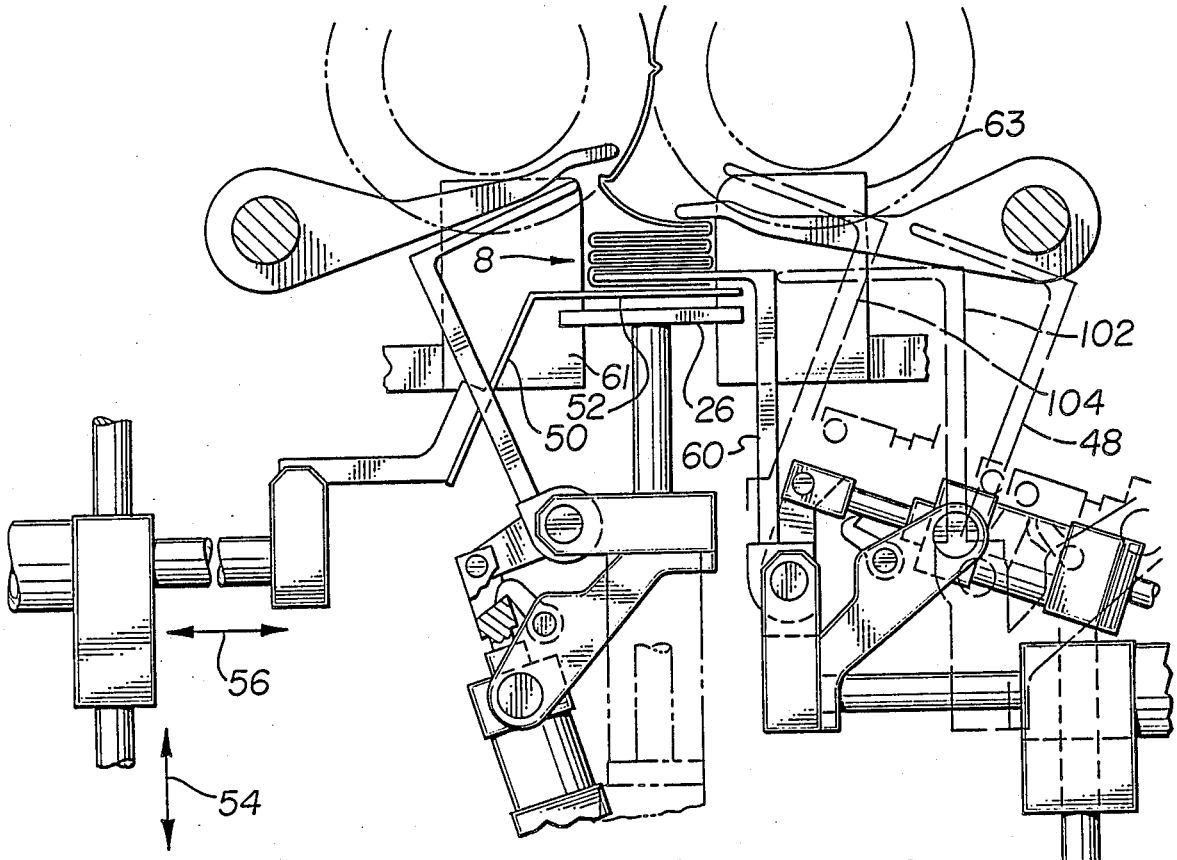
FIG. 11 illustrates elements of the machine still further in the cycle where the second count fingers are retracted and reset.

Referring now to FIG. 11, package building fingers 50 assume support of stack 8 at portion 52, when second count fingers 48 are retracted from position 60 to position 102. After count fingers 48 are clear of stack 8, they are reset to a deactuated position 104, ready to be actuated for a successive clip separation cycle.

Figure 12:
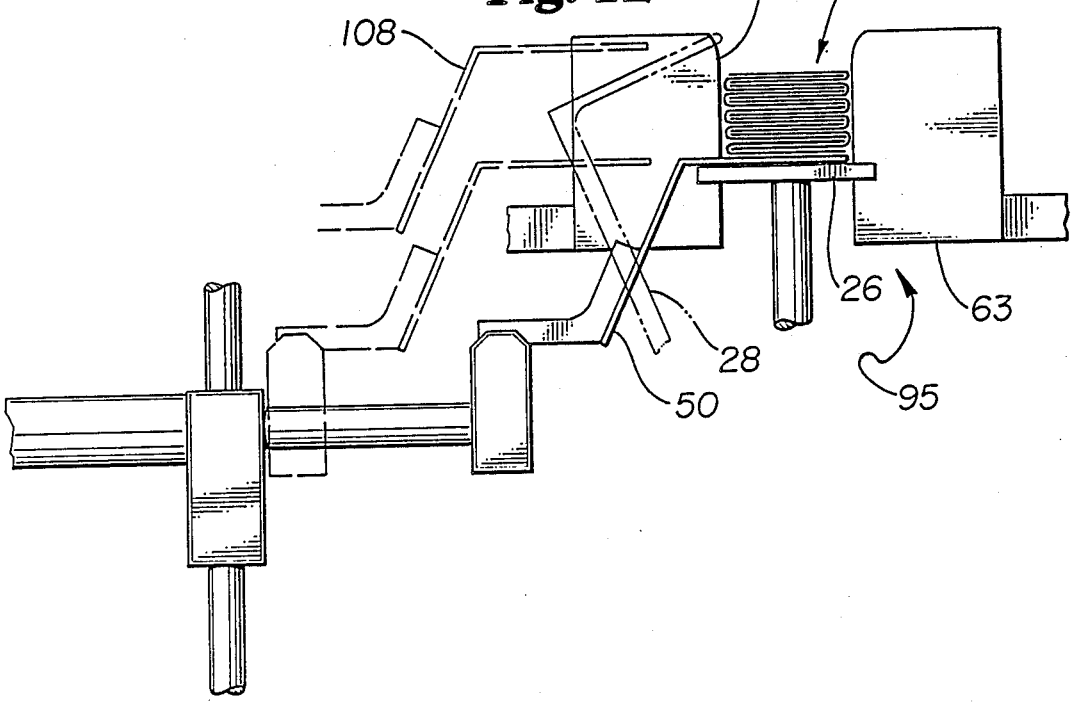
FIG. 12 illustrates elements of the machine still further in the cycle where the package build fingers are retracted, transferring stack support to the elevator table.

Referring now to FIG. 12, once table 26 has returned to the package building station 95, package build fingers 50 are retracted in the −X direction and translated in the +Y direction stopping at a deactuated or ready position 108. Once package build fingers 50 are retracted, stack 8 is supported by table 26. Guides 61 prevent movement of stack 8 in the −X direction while fingers 50 are retracted. It is to be understood that table 26 moves slowly downward at a rate equal to the build rate of the stack in the −Y direction (along the stack principal axis 5) in a manner similar to that described for platform 48 during continued stack building. After a predetermined number of layers have been interfolded into stack 8, the clip separation cycle is repeated starting with the unlatching of the first count fingers 28.

The invention is not to be taken as to be limited to all of the details of the specification hereof as variations and modifications may be made without departing from the spirit or scope of the invention.

What is claimed is:

1. A method of separating a clip of a predetermined number of interfolded sheets from a continuously building interfolding process stack comprising the steps of:

a. continuously interfolding a plurality of individual sheets on an interfolding table at a package building station to form an interfolding process stack;

b. interposing a platform count finger to an actuated position above the interfolding table after a predetermined number of sheets have been interfolded into the stack forming a clip of interfolded sheets such that the platform count finger provides a platform for continuing the interfolding process;

c. transporting the clip of the interfolding table from the package building station to a separator outlet station;

d. removing the clip from the interfolding table at the separator outlet station;

e. laterally interposing package build finger means in opposed relationship relatively closely below the platform count finger for orienting a loose end sheet portion depending from the interfolding process stack then building on the platform count finger to be the bottom-most layer when the interfolding process stack is supported by the interfolding table; and f. returning the interfolding table to the package building station and retracting the platform count finger from above the interfolding table such that the interfolding table provides a platform for continued building of the interfolding process stack.

2. The method of claim 1 further including an additional step succeeding step e., the additional step comprising:

e'. retracting the package build finger to a deactuated position.

3. The method of claim 1 further including an additional step preceding step a., the additional step comprising:

a'. interposing an initial count finger to an actuated position above the interfolding table after a predetermined number of sheets have been interfolded into a clip such that the initial count finger rests on the clip.

4. The method of claim 1 further including an additional step succeeding step e., the additional step comprising:

e''. retracting the initial count finger to a deactuated position.

5. A separator for forming clips of a predetermined number of interfolded laminar products comprising:

a. a table carriage means for selectively positioning an interfolding table means to:

i. a package building station for supporting the continuous building of a stack of interfolded laminar products, and ii. a separator outlet station for discharging a clip of a predetermined number of interfolded laminar products from said interfolding table;

b. platform count finger means selectively interposed above said table means after a predetermined number of laminar products have been interfolded into said stack for temporarily supporting the continued building of interfolded laminar products into a new stack; and c. package build finger means selectively interposed relatively closely below said platform count finger means for repositioning a loose end portion of the laminar product partially resting on said platform count finger means such that said loose end portion becomes the first layer of the next successive clip separated from said stack.

6. The separator of claim 5 further comprising initial count finger means selectively interposed above said table means for retaining said clip on said table while said carriage means moves from said package building station to said separator outlet station.

7. The separator of claim 5 further comprising stationary guide means for aligning said laminar products as they are built into a stack.

8. The separator of claim 5 wherein said table moves at a rate substantially equal to the rate of building said stack until said predetermined number of laminar products have been interfolded.

9. The separator of claim 8 wherein said table moves from said package building station to said separator outlet station at a rate substantially greater than said stack build rate.

10. An improvement for use with paper interfolding and stacking machinery of the type have folding rolls and packer fingers continuously interfolding and building individual paper sheets into a stack along a principal axis, the improvement comprising:

a. table means bi-directionally movable longitudinally along said stack principal axis and operative to:

i. support said stack of interfolded paper sheets until a predetermined number of said sheets have been stacked, and ii. move a clip made up of said predetermined number of sheets away from said folding rolls;

b. platform means movable generally transversely to said stack principal axis and operative to temporarily support said continued stack building while said table means moves said clip away from said folding rolls; and c. retention means movable longitudinally along said stack principal axis and operative to retain said clip while said table means moves said clip away from said folding rolls, said retention means having selectively releaseable means for:

i. restraining said retention means in a ready position away from said stack principal axis until said predetermined number of sheets are built into a stack, and ii. permitting said retention means to move to an actuated position after said predetermined number of sheets are built into a clip for retaining said clip on said table means while said table means moves away from said folding rolls.

11. The improvement of claim 10 further comprising non-moving guide means operative to guide the folded edges of said interfolded sheets to build said stack along said stack principal axis.

12. The improvement of claim 10 further comprising releasable platform latch means for: i) restraining said platform means in a ready position away from said stack principal axis until said predetermined number of sheets are interfolded and built into a stack, and ii) permitting said platform means to move to an actuated position towards said stack principal axis for supporting said continued stack building after said predetermined number of sheets are interfolded and built into said clip.

13. The improvement of claim 12 further comprising deceleration means operative to gradually bring said platform means to rest in the actuated position for preventing shock loading of said platform means.

14. The improvement of claim 10 further comprising carriage means for moving said table means and said retention means to an outlet position.

15. The improvement of claim 14 further comprising ejector means for ejecting said clip from between said table and said retention means while said table means is at said outlet position.

16. The improvement of claim 10 further comprising restoring means movable generally transversely to said stack principal axis for restoring a free end portion of the sheet in said continued stack building resulting from clip separation to a normal interfolded position in said stack when said stack is resupported by said table means.

17. The improvement of claim 16 wherein said restoring means comprises a plurality of thin blades which position said free end portion generally parallel to the stack supporting surface of said table means.

18. The improvement of claim 10 further comprising shock absorber means operative to prevent an abrupt stop of said retention means at said actuated position for preventing impact loading of said retention means.

19. The improvement of claim 18 wherein said deceleration means comprises a hydraulic shock absorber.

* * * * *